United States Patent [19]

Pezzoli et al.

[11] Patent Number: 4,934,545

[45] Date of Patent: Jun. 19, 1990

[54] CLOSURE WITH MICROBIAL FILTER

[75] Inventors: Paul A. Pezzoli, Worthington, Ohio; James Renick, Bristol, Wis.; Gary N. Smith, Dublin, Ohio; Jerold W. Montgomery, Libertyville, Ill.; David Hofferbert, Mundelein, Ill.; Mark Larkin, Lindenhurst, Ill.

[73] Assignee: Abbott Laboratories, Abbott Park, Ill.

[21] Appl. No.: 298,711

[22] Filed: Jan. 19, 1989

[51] Int. Cl.[5] ..... B65D 41/20

[52] U.S. Cl. ..... 215/250; 215/308

[58] Field of Search ..... 215/247, 248, 308, 309, 215/250; 604/405, 415

[56] References Cited

U.S. PATENT DOCUMENTS 4,235,344 11/1980 Kulle et al. ..... 215/308 X

*Primary Examiner*—Donald F. Norton

*Attorney, Agent, or Firm*—Donald O. Nickey; Edward H. Gorman; Patrick Phillips

[57] ABSTRACT

A closure containing an internalized microbial filter for use in enteral delivery set assemblies. The closure comprises a generally cylindrical side wall, a planar top surface having first and second projections, the first projection being associated with the spikable membrane while the second projection is associated with a filter and with means to limit air access to the filter. The closure also includes a bottom surface having an aperture which extends through the closure to the top surface thereof with the filter being secured to the bottom surface and extending across the opening of the aperture.

13 Claims, 2 Drawing Sheets

CLOSURE WITH MICROBIAL FILTER

TECHNICAL FIELD

The present invention relates generally to an enteral delivery set assembly, and more particularly, to a closure which features an internalized microbial filter.

BACKGROUND ART

Many individuals in health care facilities are able to achieve sufficient caloric intake through eating prepared meals. However, a sizable number of such patients are unable to ingest enough food to meet their body's needs. Examples of these individuals would include burn patients, whose daily caloric needs are often in excess of 5,000 calories, and critically ill, weak, or comatose patients who may be unable to chew their food. For these patients, caloric supplementation through parenteral, also known as intravenous, feeding is not a viable alternative.

In response to this problem, liquid foods have been developed for enteral feeding. Enteral feeding is providing nourishment through the oral tract by defined nutritional diets. Typically, enteral feeding utilizes a nasogastric tube to transport the liquid nutritional products from the container through the patient's nasal cavity and thence into the stomach. Early enteral nutritional product containers were empty, sterilized pouches which were filled with sterilized, canned product at the point of use. The filled pouch was spiked by a cannula. However, there are shortcomings associated with that type of packaging including potential product contamination and extensive set-up-time. In response to that problem, a multi-layer plastic bottle was developed having a central layer which provided an oxygen barrier, therefore permitting the bottle to be pre-filled with food product which provided greater shelf-life and less spoilage. This type of plastic bottle utilizes a membrane which must be pierced so as to permit the commencement of the feeding process.

However, a problem arises once cannulation has occurred since the nutritional product container periodically requires the introduction of a small amount of atmospheric air to preclude the establishment of a vacuum in the system, which would terminate the feeding process. This problem has traditionally been overcome in the pre-filled industry by the providing of a valve means to introduce atmospheric air into the enteral nutritional product container. Normally associated with such valve means is a microbial filter.

Ported closures are well known, an example of which is Steidley, U.S. Pat. No. 4,022,258 which discloses a closure for surgical irrigation fluid containers as opposed to one for enteral nutritional product containers. Steidley discloses a large spike member which can pierce a plastic cap with the spike member including a conventional filter positioned adjacent the external surface of the cap. However, Steidley does not address the unique problems associated with the physical composition of enteral nutritional products. Enteral nutritional products are dissimilar from fluids introduced by intravenous feeding primarily due to the presence of minerals and other solids which tend to form a sediment which settles to the bottom of the inverted container during feeding. Additionally, enteral nutritional products are extremely viscous.

Conventional valves associated with enteral nutritional product containers include a ball and an externally positioned filter, both of which are added to the closure structure after the molding process of the closure is completed. Although there has been a long felt need to decrease the manufacturing cost and simplify the manufacturing process associated with the valves by eliminating the ball and redesigning the filter, the fact that the exterior microbial filter currently used prevents contamination of the enteral nutritional product has discouraged experimentation.

It is thus apparent that the need exists for an improved closure for pre-filled enteral nutritional product containers which provides the less costly and more efficient production of such closures, while at the same time ensuring proper microbial filtration.

DISCLOSURE OF THE INVENTION

There is disclosed a closure for a product container, said closure comprising, a generally cylindrical side wall, said side wall having threads along the inner surface thereof for threadedly engaging the neck of said container, a planar top surface, said top surface having a first projection extending upwardly therefrom, said first projection being associated with a spikable membrane, and a bottom surface having an aperture which extends through said closure to said top surface, said bottom surface having a filter secured thereto.

There is also disclosed a closure for an enteral nutritional product container, said closure comprising, a generally cylindrical side wall, said side wall having threads along the inner surface thereof for threadedly engaging the neck of said container, a planar top surface, said top surface having a first projection and a second projection extending upwardly therefrom, said first projection being associated with a spikable membrane, said second projection being associated with a microbial filter which allows atmospheric air to enter said container and with means to limit atmospheric air access to said microbial filter, said first projection located diagonally across said closure from said means to limit atmospheric air access to said microbial filter, and a bottom surface, said bottom surface having an aperture which extends through said closure to said top surface, said microbial filter being secured to said bottom surface and extending across the opening of said aperture.

There is also disclosed a closure for a product container, said closure comprising, a generally cylindrical side wall, a planar top surface, said top surface having a first projection and a second projection, said first projection being associated with a spikable membrane, said second projection being associated with a filter and with means to limit air access to said filter, and a bottom surface, said bottom surface having an aperture which extends through said closure to said top surface, said filter being secured to said bottom surface and extending across the opening of said aperture.

Furthermore, the filter may be fabricated from a woven synthetic fiber material. The filter may be secured to the bottom surface adjacent an annular raised portion thereof.

The present invention provides an enteral delivery set assembly which permits the less costly and yet more efficient production of such closures, while at the same time ensuring proper microbial filtration.

Other aspects and advantages of the invention will be apparent from the following description, the accompanying drawings and the appended claims.

DETAILED DESCRIPTION OF THE INVENTION

Figure 1:
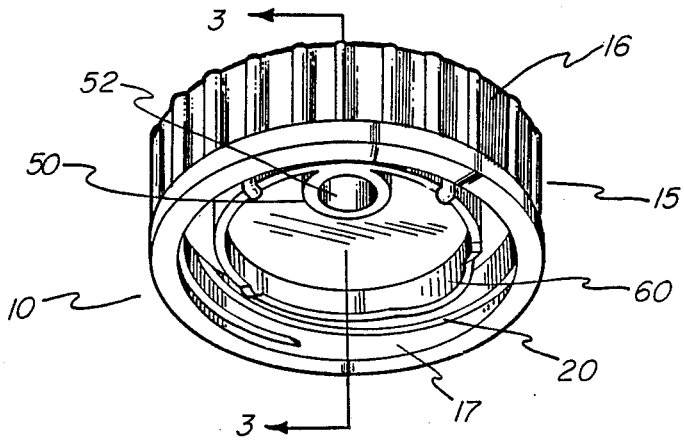
FIG. 1 is a perspective view of the closure which is utilized in an enteral delivery set assembly in accordance with the present invention shown with a portion of an enteral nutritional product container.
Figure 1:
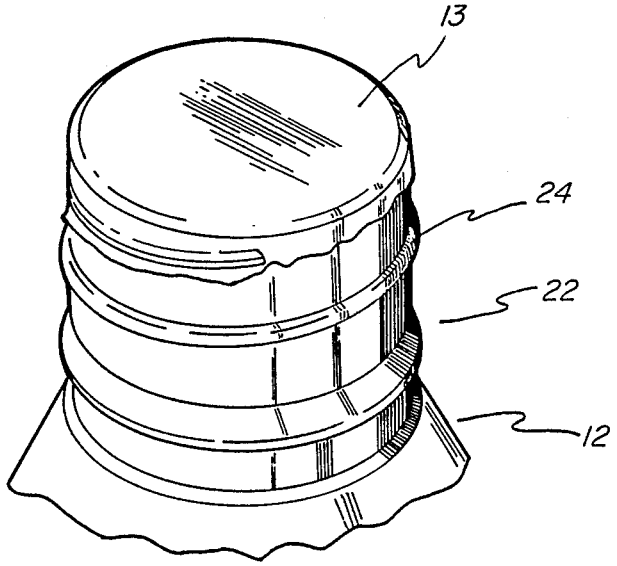

Having reference to the drawings, attention is directed first to FIG. 1 which illustrates a closure for an enteral delivery set assembly embodying this invention designated generally by the numeral 10, shown in conjunction with a portion of an enteral nutritional product container 12. The container 12 has a membrane seal 13 which typically is of foil or of thin plastic.

The closure 10 includes as a basic component thereof, cylindrical side wall 15 having an outer surface 16 as well as an inner surface 17. Along the inner surface 17 are threads 20 for threadedly engaging the closure 10 to the neck 22 of the container 12 at the threaded neck portion thereof 24.

Figure 2:
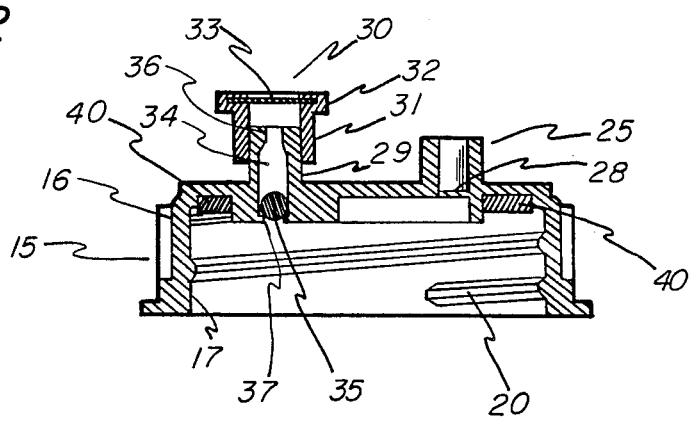
FIG. 2 is a vertical sectional view of a prior art closure similar to the sectional view taken along line 3—3 of FIG. 1.

To fully appreciate this invention, it is necessary to consider the prior art of closures for enteral nutritional product containers. Whereas prior art closures included cylindrical side walls 15 with an outer surface 16 and an inner surface 17, they also included first projection 25 which was cylindrical in shape and associated with a membrane base 28. Also extending upwardly from the top surface of the prior art closures is a second projection 29 associated with external filter means 30. The external filter means has a filter side wall 31 as well as a filter top surface 32 in which a filter 33 is retained. The interior portion of second projection 29 forms channel 34 into which ball 35 fits. The cooperation between channel 34 and ball 35 acts as a valve to permit air to enter the container to prevent vacuum build-up and thus assist with the flow of product during feeding. When the closure is in its operative mode, the container is inverted such that ball 35 rests against beveled portion 36. At other times, the ball is still retained in the channel 34 by conventional ball retention means 37. Thus, in the fabrication of the closures associated with the prior art, filter means 30, ball 35 and a gasket 40 are manually assembled into the prior art closure embodiment shown in FIG. 2. The viscous and sedimentary nature of enteral nutritional products results in a tendency for the ball to become lodged or stuck against the beveled portion 36 as product is delivered over a long time period. This condition results in partial to total system occlusion which prevents continued product delivery to the patient.

Figure 3:
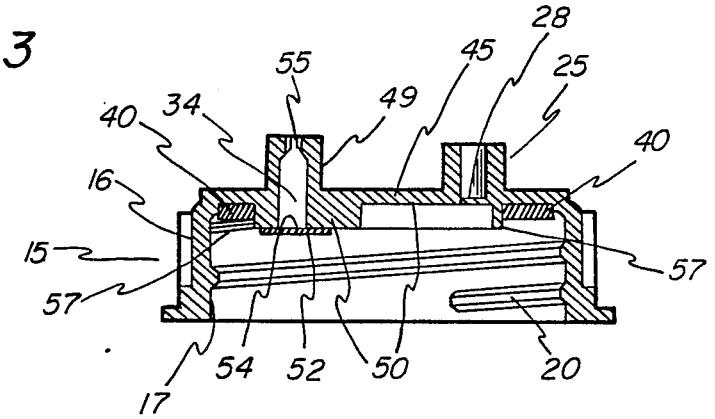
FIG. 3 is a vertical sectional view taken along line 3—3 of FIG. 1.

As can be clearly seen in FIG. 3, the closure of this invention eliminates ball 35 and with the possible exception of aesthetic purposes, eliminates the need for the housing associated with filter means 30. Extending upwardly from top surface 45 are first projection 25 and second projection 49. First projection 25 resembles conventional projections associated with cannulation of the closure, with its base including membrane 28.

Second projection 49 is of a generally cylindrical configuration. Preferably heat staked to bottom surface 50 is an internalized microbial filter 52. Heat staking or fusing occurs when two materials are brought together in the presence of sufficient heat and pressure so as to form one material. The filter is preferably woven from a synthetic, semi-permeable, hydrophobic fiber material. Commercially available materials that are useful as filters include Pallflex, a porus teflon product with a fiber backing made by the Pall Corporation and Zitex, a porus teflon material made by the Norton Company. Preferably the cap to which the filter 52 is heat staked is fabricated from a semi-rigid plastic material, such as polypropylene, a mixture of polypropylene and a thermoplastic elastomer, e.g. styrene-butadiene block copolymer or ethylene vinyl acetate.

Second projection 49 still has a channel 34 associated therewith with filter 52 stretching across the opening 54 of the aperture associated with channel 34. The upper surface of second projection 49 includes means to limit the atmospheric air access to filter 52, with these means being disclosed as air grate 55 which has several small holes into which air may pass prior to interaction with the surface of filter 52. While the interior walls of second projection 49 may be beveled near air grate 55, based on the characteristics of the molds associated with prior art closures, such beveled edges are not necessary, since the necessity for the presence of ball 35 has been eliminated.

Figure 4:
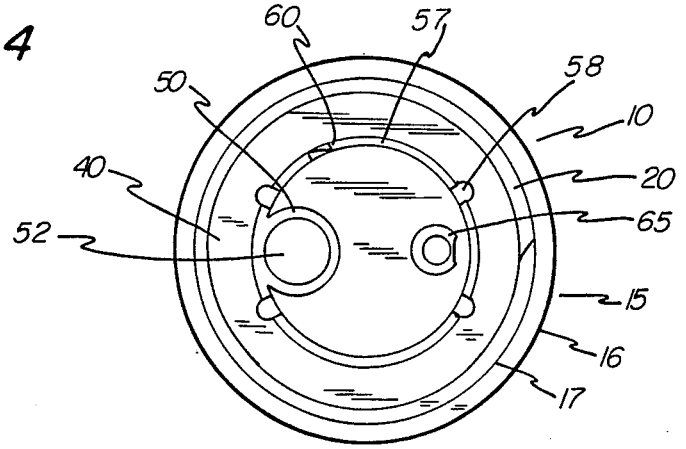
FIG. 4 is a bottom plan view of the closure shown in FIGS. 1 and 3, after cannulation has occurred.

As can be seen in FIGS. 3 and 4, an annular raised portion 57 depends from bottom surface 50, with gasket 40 being retained between inner surface 17 and the wall associated with the annular raised portion 57. If necessary, gasket 40 may be held in place by gasket retaining means 58, which may be little more than a semi-rigid flap or an outwardly radiating flange associated with the free end of the annular raised portion 57. Depending downwardly from a section of annular raised portion 57 is a plow member 60, however the closure of this invention may be fabricated without such a plow member.

Best Mode

Figure 5:
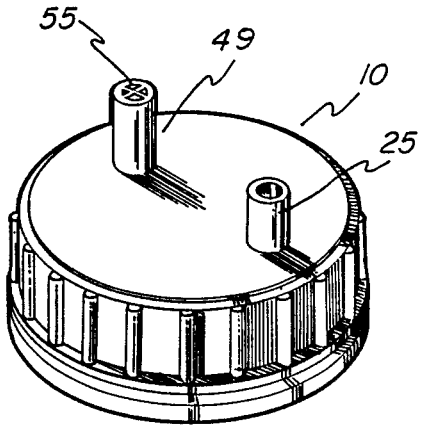
FIG. 5 is a top elevational view of the closure shown in FIGS. 1 and 3.

In actual operation, the closure 10 when viewed from the top preferably resembles the embodiment as shown in FIG. 5 with the bottom portion substantially similar to that shown in FIG. 1, including uncannulated bottom surface 50. Once cannulation occurs, membrane 28 is pierced, such that the closure when inverted on an open enteral nutritional container allows for the passage of food product through first projection 25. In the inverted position, filter 52 is in direct contact with the food product. As long as the filter is wet, it permits the introduction of atmospheric air minus the bacteria into the enteral nutritionals container. More importantly, this direct contact is critical to the invention, since if the liquid food product is allowed to dry on the filter, the dried product tends to clog the filter, thereby restricting the needed flow of air into the food product. In prior art devices, the presence of the ball tended to preclude direct contact between the food product and the filter means, such that the filter would not be sufficiently wet to worry about clogging.

Figure 6:
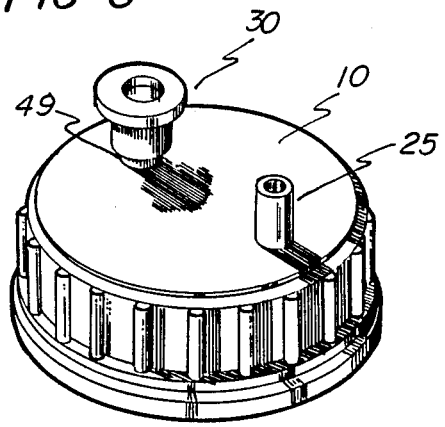
FIG. 6 is a top elevational view of a modified embodiment of the invention, which embodiment more closely resembles the prior art shown in FIG. 2.

The closure of this invention may be fabricated by molding the actual cap and then fusing the heat staked material of the filter to the bottom surface of this closure thereby obviating the need for the ball and the housing of the conventional filter means. However, as shown in FIG. 6, it may be desirable to place a conventional filter means over second projection 49, since the radical departure in appearance of the closure associated with FIG. 5, may lead some to believe that the closure does not include a microbial filter thus, for aesthetic purposes and for peace of mind for those otherwise uninformed, a conventional filter means may be utilized with the closure of this invention, although such second filter means is not necessary.

Industrial Applicability

This $500,000,000 industry has long sought to reduce the cost and simplify the manufacturing process associated with closures having microbial filters. This invention solves this long felt need. While the form of apparatus and the method of forming the same herein described constitutes a preferred embodiment of this invention, it is to be understood that the invention is not limited to this precise form of apparatus or method and that changes may be made therein without departing from the scope of the invention which is defined in the appended claims.

What is claimed is:

1. A closure for a product container, said closure comprising, a generally cylindrical side wall, said side wall having threads along the inner surface thereof for threadedly engaging the neck of said container, a planar top surface, said top surface having a first projection extending upwardly therefrom, said first projection being associated with a spikable membrane, a bottom surface having an aperture which extends through said closure to said top surface, said bottom surface having a filter secured thereto, and means to limit atmospheric air access to said filter, said top surface having a second projection extending upwardly therefrom, said second projection associated with said means to limit atmospheric air access to said filter.

2. The closure as claimed in claim 1 wherein said filter is heat staked material which is fused to said bottom surface.

3. The closure as claimed in claim 1 wherein said filter is a microbial filter.

4. The closure as claimed in claim 3 wherein said filter is fabricated from a woven synthetic fiber material.

5. The closure as claimed in claim 4 wherein said closure is fabricated from a semi-rigid plastic material.

6. The closure as claimed in claim 5 wherein said filter forms a semi-permeable membrane.

7. The closure as claimed in claim 6 wherein said filter is fabricated from Zitex.

8. The closure as claimed in claim 6 wherein said filter is fabricated from Pallflex.

9. The closure as claimed in claim 1 wherein said bottom surface has an annular raised portion, said filter being secured adjacent said annular raised portion.

10. The closure as claimed in claim 9 wherein said filter is secured centrally of said raised annular portion.

11. The closure as claimed in claim 10 wherein said first projection is located diagonally across said closure from said means to limit atmospheric air access to said filter.

12. A closure for an enteral nutritional product container, said closure comprising a generally cylindrical side wall, said side wall having threads along the inner surface thereof for threadedly engaging the neck of said container, a planar top surface, said top surface having a first projection and a second projection extending upwardly therefrom, said first projection being associated with a spikable membrane, said second projection being associated with a microbial filter which allows atmospheric air to enter said container and with means to limit atmospheric air access to said microbial filter, said first projection located diagonally across said closure from said means to limit atmospheric air access to said microbial filter, and a bottom surface, said bottom surface having an aperture which extends through said closure to said top surface, the improvement characterized in that said microbial filter is secured to said bottom surface and extends across the opening of said aperture.

13. A closure for a product container, said closure comprising, a generally cylindrical side wall, a planar top surface, said top surface having a first projection and a second projection, said first projection being associated with a spikable membrane, said second projection being associated with a filter and with means to limit air access to said filter, and a bottom surface, said bottom surface having an aperture which extends through said closure to said top surface, said filter being secured to said bottom surface and extending across the opening of said aperture.

* * * * *